US008634738B2

(12) United States Patent
Oh et al.

(10) Patent No.: US 8,634,738 B2
(45) Date of Patent: Jan. 21, 2014

(54) HIGH VOLTAGE POWER SUPPLY AND METHOD OF OUTPUTTING PLUS/MINUS HIGH-VOLTAGE IN IMAGE FORMING APPARATUSES

(75) Inventors: Chul-woo Oh, Suwon-si (KR); Jong-hwa Cho, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 545 days.

(21) Appl. No.: 12/695,317

(22) Filed: Jan. 28, 2010

(65) Prior Publication Data

US 2011/0058841 A1 Mar. 10, 2011

(30) Foreign Application Priority Data

Sep. 8, 2009 (KR) ..... 10-2009-0084434

(51) Int. Cl.
*G03G 15/00* (2006.01)

(52) U.S. Cl.
CPC ..... *G03G 15/80* (2013.01)
USPC ..... 399/88; 399/37

(58) Field of Classification Search
USPC ..... 399/37, 53, 88–90; 307/17, 31, 75
See application file for complete search history.

(56) References Cited

U.S. PATENT DOCUMENTS 5,568,226 A * 10/1996 Kusano ..... 399/88
2003/0072583 A1* 4/2003 Doi ..... 399/88
2004/0228049 A1* 11/2004 Chae et al. ..... 361/18

* cited by examiner

*Primary Examiner* — Walter L Lindsay, Jr.
*Assistant Examiner* — Jessica L Eley
(74) *Attorney, Agent, or Firm* — Stanzione & Kim, LLP

(57) ABSTRACT

A high-voltage power supply to output a plus/minus high-voltage, which is applied to image forming apparatuses, includes a plus high-voltage output unit outputting the plus high-voltage by using a Pulse Width Modulation (PWM) signal, a minus high-voltage operation control unit charging a certain voltage while the plus high-voltage output unit is outputting the plus high-voltage, a minus high-voltage output unit outputting the minus high-voltage by using the certain voltage charged in the minus high-voltage operation control unit, and a minus high-voltage blocking unit to block the output of the minus high-voltage from the minus high-voltage output unit while the plus high-voltage output unit is outputting the plus high-voltage.

27 Claims, 4 Drawing Sheets

HIGH VOLTAGE POWER SUPPLY AND METHOD OF OUTPUTTING PLUS/MINUS HIGH-VOLTAGE IN IMAGE FORMING APPARATUSES

CROSS-REFERENCE TO RELATED APPLICATIONS

This application claims priority under 35 U.S.C. §119 of Korean Patent Application No. 10-2009-0084434, filed on Sep. 8, 2009, in the Korean Intellectual Property Office, the disclosure of which is incorporated herein in its entirety by reference.

BACKGROUND

1. Field of the Invention

The present general inventive concept relates to a high-voltage power supply and a method of outputting a plus/minus high-voltage, which are used in image forming apparatuses.

2. Description of the Related Art

In general, a high-voltage power supply is used in electronic apparatuses that require a high-voltage direct current (DC) source, such as laser printers (for example, laser beam printers (LBPs)) or fax machines. In electrophotographic image forming apparatuses, light is irradiated to a photoconductor charged at a certain potential in order to form an electrostatic latent image on a surface of the photoconductor, and then toner is supplied to the electrostatic latent image in order to develop the electrostatic latent image into a visible image. The visible image formed on the photoconductor is transferred directly to a printing medium or transferred to the printing medium via an intermediate medium. The visible image transferred to the printing medium is fixed to printing medium while passing a fuser. A plus high-voltage and a minus high-voltage are used to clean the electrostatic latent image on the surface of the photoconductor. However, since two input ports for inputting signals for respectively driving a plus high-voltage output unit and a minus high-voltage output unit are required to output the plus high-voltage and the minus high-voltage, and the two input ports need to be controlled individually, the circuit of the high-voltage power supply is complicated, and may be expensive. Accordingly, a high-voltage power supply capable of outputting a plus high-voltage and a minus high-voltage even when having a simple circuit structure using a single input port is required.

SUMMARY

The present general inventive concept provides a high-voltage power supply to output a plus/minus high-voltage, which may be used in image forming apparatuses, and a method of outputting a plus/minus high-voltage.

Additional aspects and utilities of the present general inventive concept will be set forth in part in the description which follows and, in part, will be obvious from the description, or may be learned by practice of the general inventive concept.

Features and/or utilities of the present general inventive concept may be realized by a high-voltage power supply to output a plus/minus high-voltage, the high-voltage power supply including a plus high-voltage output unit to output the plus high-voltage by using a pulse width modulation (PWM) signal, a minus high-voltage operation control unit to charge a certain voltage while the plus high-voltage output unit is outputting the plus high-voltage, a minus high-voltage output unit to output the minus high-voltage by using the certain voltage charged in the minus high-voltage operation control unit, and a minus high-voltage blocking unit to block the outputting of the minus high-voltage from the minus high-voltage output unit while the plus high-voltage output unit is outputting the plus high-voltage.

Features and/or utilities of the present general inventive concept may also be realized by a method of outputting a plus/minus high-voltage, the method including outputting the plus high-voltage by using a PWM signal, charging a certain voltage while the plus high-voltage is being output, and outputting the minus high-voltage within a period of time from when outputting the plus high-voltage is stopped to when all of the accumulated voltage is discharged, wherein the minus high-voltage and the plus high-voltage are not output simultaneously.

According to another aspect of the present general inventive concept, there is provided a computer-readable recording medium having recorded thereon a program to execute the method of outputting the plus/minus high-voltage.

Features and/or utilities of the present general inventive concept may also be realized by a high-voltage power supply, including a positive high-voltage output unit to receive a first input signal and to output a positive high-voltage corresponding to the first input signal, a negative high-voltage output unit to receive a second input signal and to output a negative high-voltage corresponding to the second input signal, and a negative high-voltage blocking unit to prevent the negative high-voltage output unit from outputting a negative high-voltage when the positive high-voltage output unit outputs a positive high-voltage.

The negative high-voltage blocking unit may include an RC filter to receive an input from the positive high-voltage output unit and a transistor having a gate connected to the input from the positive high-voltage output unit, the transistor configured to output a ground signal to the negative high-voltage output unit when the gate is on.

The positive high-voltage output unit and the negative high-voltage output unit may be connected to a same output terminal.

The high-voltage power supply may further include a negative high-voltage operation control unit to supply an input voltage to the negative high-voltage output unit.

The negative high-voltage operation control unit may include a capacitor to charge when the positive high-voltage output unit outputs a positive, high voltage and to discharge when the positive high-voltage output unit does not output a positive, high voltage.

The capacitor may be an electrolytic capacitor.

The negative high-voltage operation control unit may include a transistor having a gate connected to the first input and a source connected to a power supply, to output a predetermined voltage from the power supply to the capacitor to charge the capacitor when the gate is on.

The capacitor of the negative high-voltage operation control unit may be connected to an input from the positive high-voltage output unit, a voltage level of the input corresponding to a voltage level output from the positive high-voltage output unit.

Features and/or utilities of the present general inventive concept may be realized by a method of outputting a positive high-voltage and a negative high-voltage, the method including converting a first input signal into a positive high-voltage output signal, converting a second input signal into a negative high-voltage output signal, and blocking the output of the negative high-voltage signal when the positive high-voltage signal is output.

Blocking the output of the negative high-voltage signal may include outputting a ground signal to a negative high-voltage output unit when the positive high-voltage signal is output.

The method may further include outputting the second input signal to a negative high-voltage output unit only when the positive high-voltage signal is not output.

Outputting the second input signal may include charging a capacitor when the positive high-voltage signal is output and discharging the capacitor as the second input signal when the positive high-voltage signal is not output.

Features and/or utilities of the present general inventive concept may also be realized by an image-forming apparatus, including an image-development unit to receive data and to form an image on a recording medium, the image-development unit including a photoconductor to form an electrostatic latent image and a high-power voltage supply having an output node connected to the photoconductor to control a charge of the photoconductor. The high-power voltage supply may include a positive high-voltage output unit to receive a first input signal and to output to the output node a positive high-voltage corresponding to the first input signal, a negative high-voltage output unit to receive a second input signal and to output to the output node a negative high-voltage corresponding to the second input signal, and a negative high-voltage blocking unit to prevent the negative high-voltage output unit from outputting a negative high-voltage when the positive high-voltage output unit outputs a positive high-voltage.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
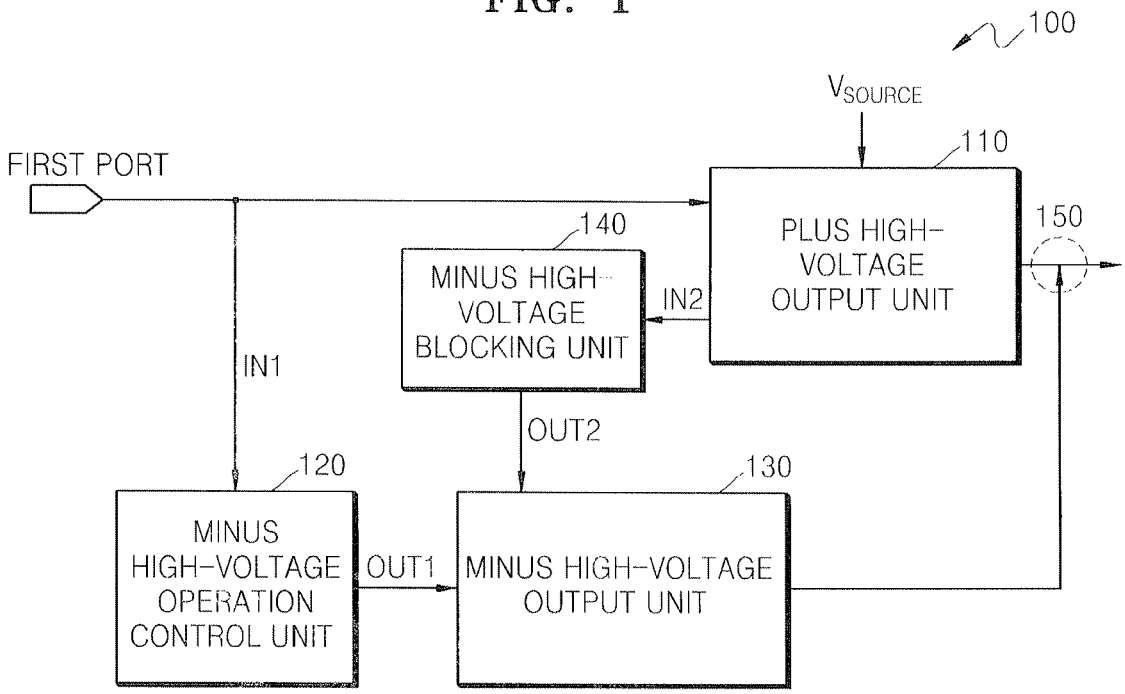
FIG. 1 is a block diagram of a high-voltage power supply to output plus/minus high-voltage, which is used in an image forming apparatus, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of a high-voltage power supply 100 to output a plus/minus high-voltage, which may be used in image forming apparatuses, according to an embodiment of the present general inventive concept. The "plus/minus" high-voltage may also be referred to as a positive/negative voltage. Referring to FIG. 1, the high-voltage power supply 100 according to the present embodiment includes a plus high-voltage output unit 110, a minus high-voltage operation control unit 120, a minus high-voltage output unit 130, and a minus high-voltage blocking unit 140.

The plus high-voltage output unit 110 receives a pulse width modulation (PWM) signal via a first port, transforms a power source voltage Vsource input to the plus high-voltage output unit 110 into the plus high-voltage by using the received PWM signal, and outputs the plus high-voltage to an output terminal 150. The plus high-voltage output unit 110 transforms the PWM signal into a direct current (DC) signal using a low-pass filter, compares the DC signal with a reference signal, and generates a control signal corresponding to a result of the comparison. The plus high-voltage output unit 110 transforms the power source voltage Vsource into a high voltage by boosting the power source voltage Vsource according to the control signal, then rectifies the high voltage into a plus DC high voltage, and then outputs the plus DC high voltage to the output terminal 150. Since the plus high-voltage output unit 110 outputs the plus DC high voltage by using the PWM signal, the plus high-voltage output unit 110 may output the plus DC high voltage as long as the PWM signal is input.

The minus high-voltage operation control unit 120 charges a certain voltage while the plus high-voltage output unit 110 is outputting the plus high-voltage. In an embodiment of the present general inventive concept, since the plus high-voltage output unit 110 outputs the plus DC high voltage while the PWM signal is being received, the minus high-voltage operation control unit 120 therefore charges a certain voltage while the PWM signal is being received by the plus high-voltage output unit 110.

Figure 2:
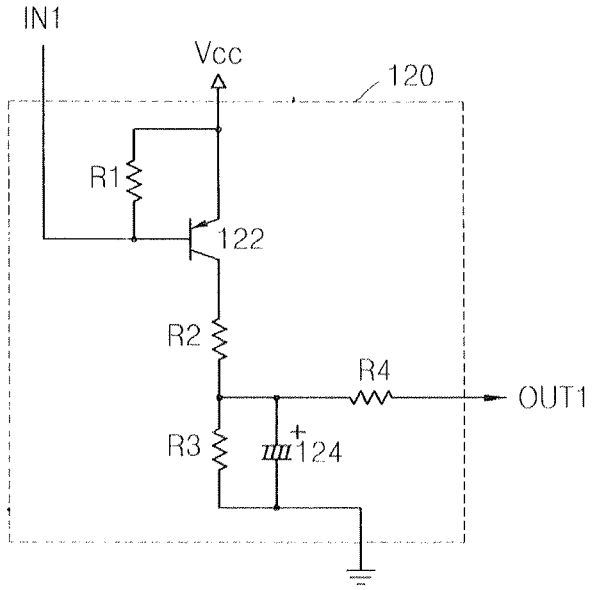
FIG. 2 is a circuit diagram of a minus high-voltage operation control unit included in the high-voltage power supply illustrated in FIG. 1.

FIG. 2 is a circuit diagram of the minus high-voltage operation control unit 120 illustrated in FIG. 1. Referring to FIG. 2, the minus high-voltage operation control unit 120 may include a PNP transistor 122, an electrolytic capacitor 124, and a plurality of resistors R1, R2, R3, and R4. A driving voltage Vcc is connected to an emitter of the PNP transistor 122, a base of the PNP transistor 122 is connected to the first port via a first input terminal IN1, and a collector of the PNP transistor 122 is grounded via the resistors R2 and R3. When the PWM signal output by the first port is received by the base of the PNP transistor 122 via the first input terminal IN1, if the PWM signal is a low signal, an emitter-base voltage Veb applied between the emitter and the base of the PNP transistor 122 is 0.7[V] or greater, and thus the emitter and the collector of the PNP transistor 122 are electrically connected to each other. When the emitter and the collector of the PNP transistor 122 are electrically connected to each other, the driving voltage Vcc connected to the emitter flows to the collector, and the driving voltage Vcc charges the electrolytic capacitor 124. As such, the minus high-voltage control unit 120 is charged with the driving voltage Vcc according to the PWM signal. Although an electrolytic capacitor is used as a voltage-charging device in the present embodiment, the other devices may be used as long as they are capable of storing a voltage therein. Types and capacities of capacitors that may be used may vary depending on the amount of charge to be charged. As such, since the plus high-voltage output unit 110 outputs the plus high-voltage during reception of the PWM signal, and the minus high-voltage operation control unit 120 controls the electrolytic capacitor 124 to be charged with a voltage during reception of the PWM signal, the minus high-voltage operation control unit 120 controls the electrolytic capacitor 124 to be charged with a voltage while the plus high-voltage output unit 110 is outputting the plus high-voltage. In other words, a duration in which the plus high-voltage output unit 110 outputs the plus high-voltage is the same as a duration in which the minus high-voltage operation control unit 120 controls the electrolytic capacitor 124 to be charged with a voltage.

Referring back to FIG. 1, the minus high-voltage output unit 130 outputs a minus high-voltage using the voltage charged in the minus high-voltage operation control unit 120. The minus high-voltage output unit 130 receives the voltage stored in the minus high-voltage operation control unit 120 and outputs the minus high-voltage using the stored voltage. The minus high-voltage output unit 130 operates or does not operate according to a signal received from the minus high-voltage blocking unit 140. The minus high-voltage output unit 130 may output the minus high-voltage by using a ringing choke converter (RCC). The RCC includes a driving transistor and a driving resistor, and as the driving transistor operates, the minus high-voltage output unit 130 outputs the minus high-voltage. According to an embodiment of the present general inventive concept, the operation of the driving transistor may be controlled using the minus high-voltage blocking unit 140.

While the plus high-voltage output unit 110 is outputting the plus high-voltage, the minus high-voltage blocking unit 140 blocks the minus high-voltage output unit 130 from outputting the minus high-voltage.

Figure 3:
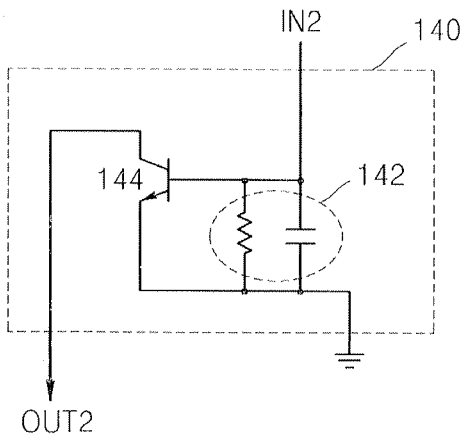
FIG. 3 is a circuit diagram of a minus high-voltage blocking unit included in the high-voltage power supply illustrated in FIG. 1.

FIG. 3 is a circuit diagram of the minus high-voltage blocking unit 140 illustrated in FIG. 1. Referring to FIG. 3, the minus high-voltage blocking unit 140 includes a resistor capacitor (RC) filter 142 and a NPN transistor 144, and receives the DC voltage from the plus high-voltage output unit 110 via a second input terminal 1N2. The plus high-voltage output unit 110 generates the DC voltage by using the received PWM signal, the DC voltage is input to the minus high-voltage blocking unit 140 via the second input terminal 1N2, and the DC voltage is applied to the RC filter 142. Referring to FIG. 3, since the RC filter 142 is located between a base and an emitter of the NPN transistor 144, a base-emitter voltage Vbe applied between the base and emitter of the NPN transistor 144 by the DC voltage is 0.7[V] or greater, and thus the emitter and the collector of the NPN transistor 144 are electrically connected to each other. Therefore, a collector of the NPN transistor 144 is connected to the emitter thereof, which is grounded, and a ground voltage is applied to the collector of the NPN transistor 144. Accordingly, the ground voltage is output via a second output terminal OUT2 of the minus high-voltage blocking unit 140. Then, the ground voltage is input to the minus high-voltage output unit 130, stopping the driving transistor of the minus high-voltage output unit 130 from driving. Thus, when the minus high-voltage blocking unit 140 outputs the ground voltage, the minus high-voltage output unit 130 does not output the minus high-voltage. According to an embodiment of the present general inventive concept, while the plus high-voltage output unit 110 is outputting the plus high-voltage, the minus high-voltage blocking unit 140 outputs the ground voltage to the minus high-voltage output unit 130, and the ground voltage serves as a disable signal that blocks the minus high-voltage output unit 130 from outputting the minus high-voltage. According to an embodiment of the present general inventive concept, the ground voltage output by the minus high-voltage blocking unit 140 is output to the minus high-voltage output unit 130 and then input to a base of the driving transistor of the minus high-voltage output unit 130, thereby turning off the driving transistor. Therefore, the minus high-voltage output unit 130 may not output the minus high-voltage.

Referring back to the minus high-voltage output unit 130 of FIG. 1, the minus high-voltage output unit 130 does not output the minus high-voltage while the plus high-voltage output unit 110 is outputting the plus high-voltage, and outputs the minus high-voltage within a period of time from when the plus high-voltage output unit 110 stops outputting the plus high-voltage to when all of the voltage stored in the minus high-voltage operation control unit 120 is discharged. As such, a duration in which the minus high-voltage is output corresponds to the amount of voltage stored, and the amount of voltage stored may be controlled according to a duration in which the plus high-voltage is output and the capacity of the electrolytic capacitor 124 that stores the voltage. However, when the plus high-voltage output unit 110 outputs the plus high voltage again before all of the voltage stored in the minus high-voltage operation control unit 120 is output, the minus high-voltage output unit 130 outputs the minus high-voltage only until when the plus high-voltage output unit 110 outputs the plus high-voltage again. The minus high-voltage output unit 130 outputs the minus high-voltage via the output terminal 150. As such, in the high-voltage power supply 100 outputting the plus/minus high-voltage, the plus high-voltage output unit 110 and the minus high-voltage output unit 130 output the plus high-voltage and the minus high-voltage, respectively, via the same output terminal 150. In addition, in the high-voltage power supply 100 outputting the plus/minus high-voltage, the plus high-voltage output unit 110 and the minus high-voltage output unit 130 do not output the plus high-voltage and the minus high-voltage at the same time. As such, the high-voltage power supply 100 outputting the plus/minus high-voltage may output the plus high-voltage and the minus high-voltage by using only the PWM signal received via the first port.

Figure 4:
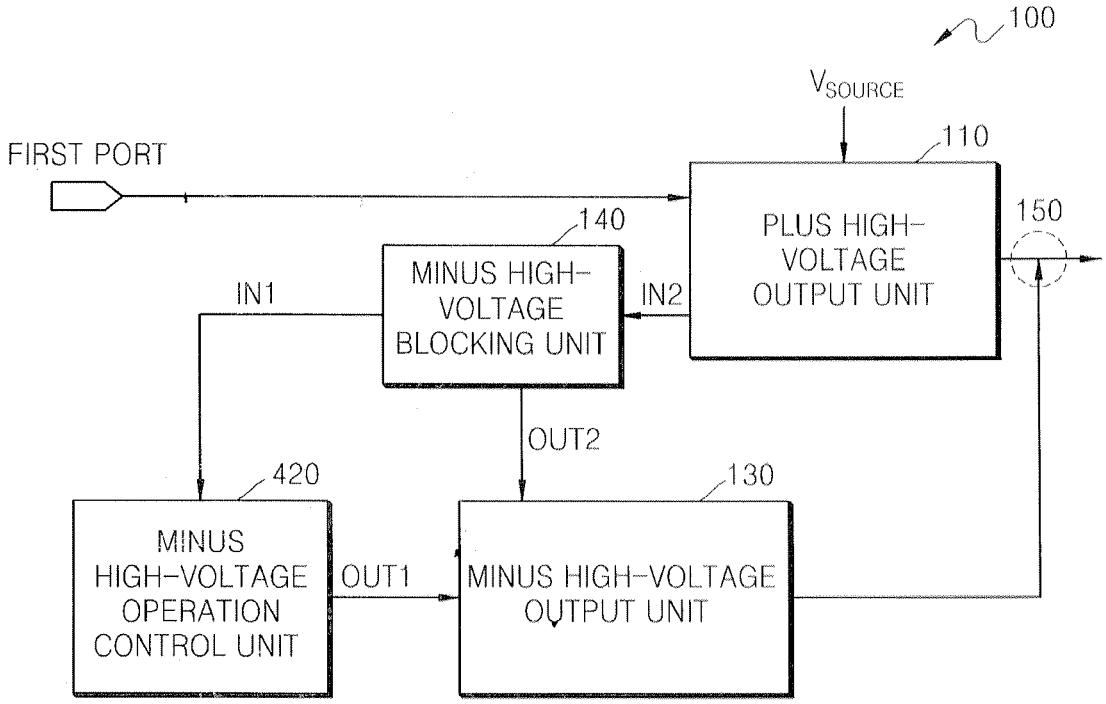
FIG. 4 is a block diagram of a high-voltage power supply to output plus/minus high-voltage, which is used in an image forming apparatus, according to another embodiment of the present general inventive concept.

FIG. 4 is a block diagram of a high-voltage power supply 100 to output a plus/minus high-voltage, which may be used in image forming apparatuses, according to another embodiment of the present general inventive concept. The structure of the high-voltage power supply 100 according to the present embodiment is similar to that of the high-voltage power supply 100 of FIG. 1, except for the structure and operation of a minus high-voltage operation control unit 420. The minus high-voltage operation control unit 420 in the present embodiment is charged with a voltage generated by a plus high-voltage output unit 110, in contrast with the minus high-voltage operation control unit 120 of FIG. 1.

Figure 5:
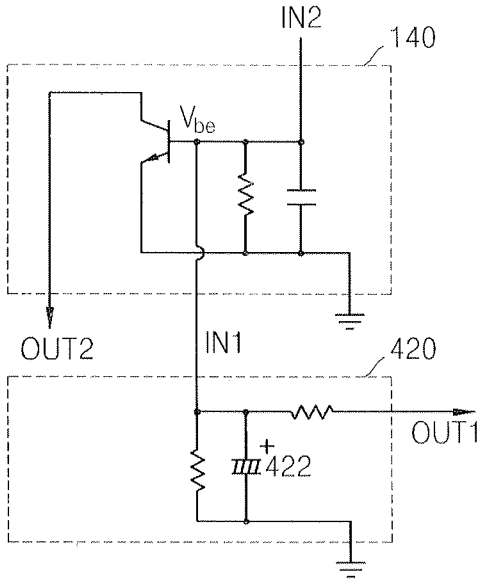
FIG. 5 is a circuit diagram of a minus high-voltage operation control unit and a minus high-voltage blocking unit included in the high-voltage power supply illustrated in FIG. 4.

FIG. 5 is a circuit diagram of the minus high-voltage operation control unit 420 and a minus high-voltage blocking unit 140 included in the high-voltage power supply 100.

The minus high-voltage operation control unit 420 receives from the minus high-voltage blocking unit 140 a base-emitter voltage Vbe generated in the plus high-voltage output unit 110 by using a PWM signal, and charges an electrolytic capacitor 422 with the base-emitter voltage Vbe. As such, the minus high-voltage operation control unit 420 does not use the driving voltage Vcc, and receives a voltage generated in the plus high-voltage output unit 110 by using the PWM signal, from the minus high-voltage blocking unit 140, and the minus high-voltage operation control unit 420 is charged with the voltage. As such, according to embodiments of the present general inventive concept, a PWM signal received via a single port may output the plus high-voltage and the minus high-voltage by driving a plus high-voltage output unit and a minus high-voltage output unit. Accordingly, this structure according to embodiments of the present general inventive concept is more efficient than a structure using separate control circuits that use two ports to output the plus high-voltage and the minus high-voltage, receive PWM signals to output the plus high-voltage and the minus high-voltage via the two ports, and control the outputs of the plus high-voltage and the minus high-voltage, respectively, so that the plus high-voltage and the minus high-voltage are not output simultaneously.

Figure 6:
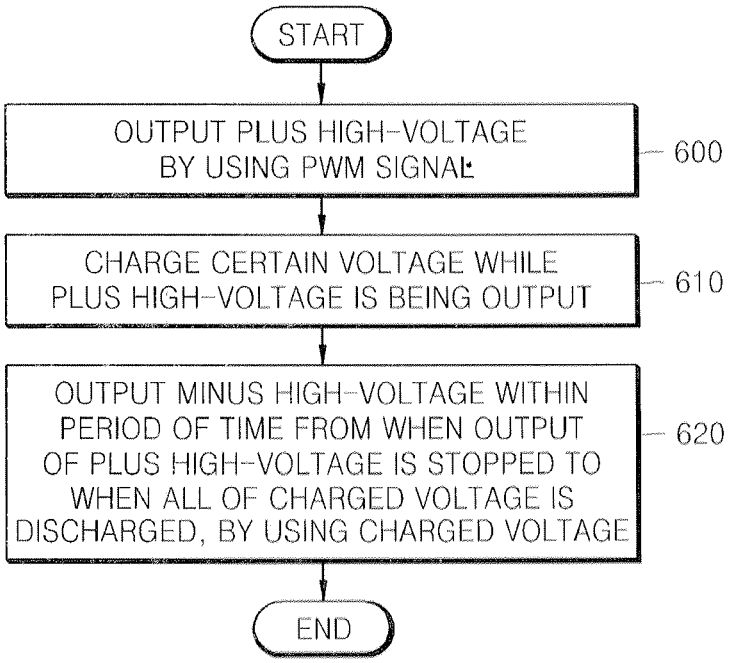
FIG. 6 is a flowchart of a method of outputting a plus/minus high-voltage, which is used in an image forming apparatus, according to an embodiment of the present general inventive concept.

FIG. 6 is a flowchart of a method of outputting a plus/minus high-voltage, which may be used in image forming apparatuses, according to an embodiment of the present general inventive concept. The method will now be described with reference to the high-voltage power supply 100 according to the embodiments illustrated in FIGS. 1 through 5.

In operation 600, a plus high-voltage is output according to a PWM signal. A power source voltage Vsource is transformed into the plus high-voltage by using the PWM signal, and the plus high-voltage is then output. In an embodiment of the present general inventive concept, the PWM signal is transformed into a DC signal using a low-pass filter, the DC signal is compared with a reference signal, and a control signal corresponding to a result of the comparison is generated. The power source voltage Vsource is boosted according to the control signal so as to be transformed into a high voltage, then the high voltage is rectified into a plus, or positive, DC high voltage, and then the plus DC high voltage is output.

In operation 610, a certain voltage is charged while the plus high-voltage is being output. According to an embodiment of the present general inventive concept, since the plus high-voltage is output according to the PWM signal, the plus high-voltage is output while the PWM signal is being received. Accordingly, a certain voltage generated by using the PWM signal is charged while the PWM signal is being received.

In operation 620, by using the stored voltage, a minus, or negative, high-voltage is output between a time when outputting the plus high-voltage is stopped and a time when all of the stored voltage is discharged. As such, according to an embodiment of the present general inventive concept, while the plus high-voltage is being output, outputting of the minus high-voltage is interrupted. When the output of the plus high-voltage is stopped, the interruption of the output of the minus high-voltage is released. Accordingly, by using the stored voltage, the minus high-voltage is output between the time when outputting of the plus high-voltage is stopped and the time when all of the stored voltage is discharged.

As such, according to an embodiment of the present general inventive concept, a duration in which the minus high-voltage is output corresponds to the amount of voltage stored, and the amount of voltage stored may be controlled according to a duration in which the plus high-voltage is output and the capacity of a capacitor that is charged with the voltage.

However, if the plus high-voltage output stops, the minus high-voltage begins, and the plus high voltage is output again before all of the stored voltage is output from the minus high-voltage output control unit, then the minus high-voltage is stopped, or in other words, it is output only until the plus high-voltage is output again. Therefore, a time that the minus high-voltage is output and a duration of the minus high-voltage may be controlled by the plus high-voltage output. As such, in the method of outputting the plus/minus high-voltage according to the present embodiment, the minus high-voltage is not output while the plus high-voltage is being output, so that the plus high-voltage and the minus high-voltage are not output at the same time.

Figure 7:
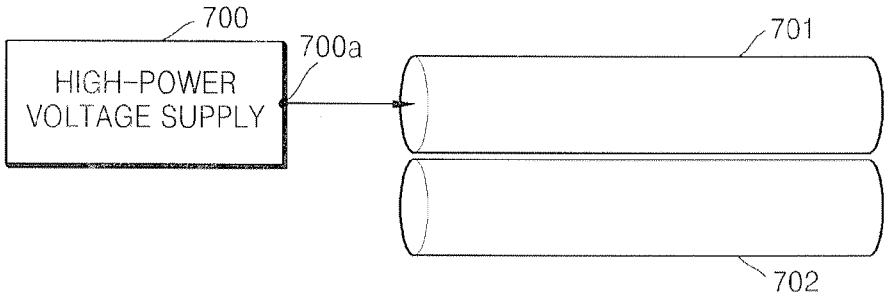
FIG. 7 illustrates a high-voltage power supply unit according to the present general inventive concept connected to a photoconductive roller.

FIG. 7 illustrates a high-power voltage supply 700 having an output node 700*a* connected to a photoconductor 701. The photoconductor 701 may apply an image formed by an electrostatic image onto a recording medium directly or via an intermediate medium 702. In FIG. 7, the photoconductor 701 and the intermediate medium 702 may be rollers. The output node 700*a* may be a single node connected to the electrostatic medium 701 to control an electrical charge of the electrostatic medium 701.

Figure 8:
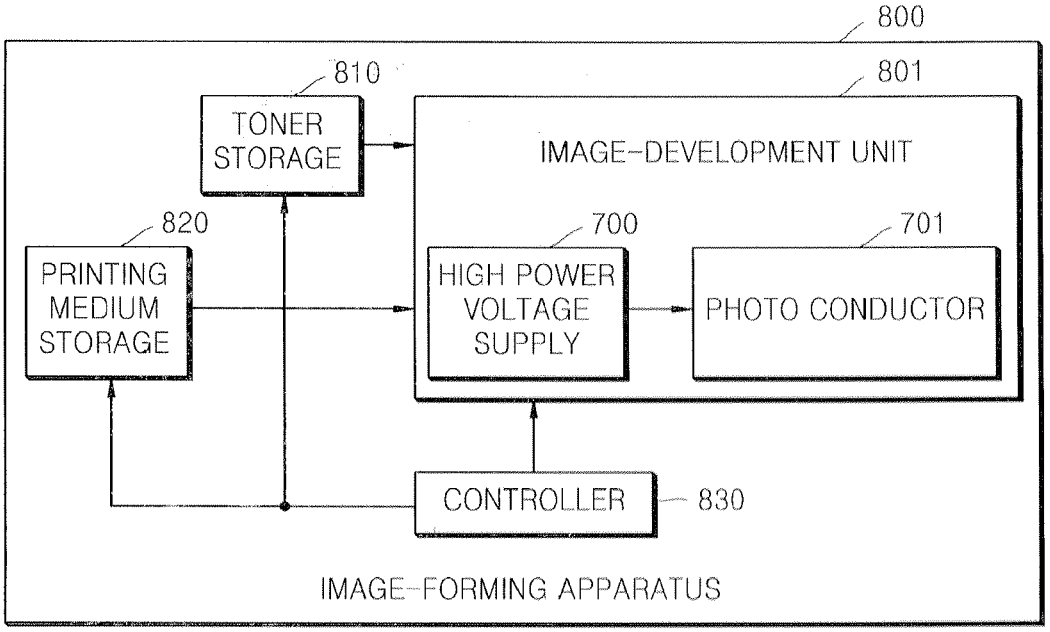
FIG. 8 illustrates a block diagram of an image-forming apparatus including a high-voltage power supply according to the present general inventive concept.

FIG. 8 illustrates an image-forming apparatus 800 including a high-power voltage supply 700 according to the present general inventive concept. The image-forming apparatus 800 may include an image-development unit 801 including the high-power voltage supply 700 and the photoconductor 701 to form an image on a recording medium. The apparatus 800 may further include a toner storage area 810 and a printing medium storage area 820 to provide toner and a printing medium to the image-development unit 801.

The image-forming apparatus 800 may further include a controller 830 to control operation of the image-development unit 801, the toner storage 810, the printing medium storage 820, and any other functions of the image-forming apparatus 800. For example, the controller 830 may control a quality, speed, or other characteristic of the image-developing unit 801, a display (not shown), or transmission of data to or from the image-forming apparatus 800. The controller may be, for example, a processor, logic, memory, or a combination thereof.

The embodiments of the present general inventive concept can be written as computer programs and can be implemented in general-use digital computers that execute the programs using a computer readable recording medium. The structure of data used in the above-described embodiments of the present general inventive concept may be recorded in a computer readable recording medium via any of several means. Examples of the computer readable recording medium include magnetic storage media (e.g., ROM, floppy disks, hard disks, etc.) and optical recording media (e.g., CD-ROMs, or DVDs). The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A high-voltage power supply to output a plus/minus high-voltage, the high-voltage power supply comprising:

a plus high-voltage output unit to output the plus high-voltage by using a pulse width modulation (PWM) signal;

a minus high-voltage operation control unit to charge a certain voltage, wherein the certain voltage is the minus high voltage for a minus high voltage source in the minus high-voltage operation control unit while the plus high-voltage output unit is outputting the plus high-voltage;

a minus high-voltage output unit to output the minus high-voltage by using the certain voltage charged in the minus high-voltage operation control unit; and a minus high-voltage blocking unit to block the outputting of the minus high-voltage from the minus high-voltage output unit with a voltage output by the plus high-voltage output unit while the plus high-voltage output unit is outputting the plus high-voltage.

2. The high-voltage power supply of claim 1, wherein the minus high-voltage operation control unit charges a voltage supplied from a power source outside the plus high-voltage output unit according to the PWM signal, while the plus high-voltage output unit is outputting the plus high-voltage.

3. The high-voltage power supply of claim 1, wherein the minus high-voltage operation control unit charges a voltage supplied from the plus high-voltage output unit according to the PWM signal, while the plus high-voltage output unit is outputting the plus high-voltage.

4. The high-voltage power supply of claim 1, wherein the minus high-voltage operation control unit charges the certain voltage in an electrolytic capacitor.

5. The high-voltage power supply of claim 1, wherein the minus high-voltage output unit outputs the minus high-voltage within a period of time from when the plus high-voltage output unit stops outputting the plus high-voltage to when all of the voltage charged in the minus high-voltage operation control unit is discharged.

6. The high-voltage power supply of claim 5, wherein when the plus high-voltage output unit outputs the plus high voltage before all of the voltage charged in the minus high-voltage operation control unit is discharged, the minus high-voltage output unit stops outputting the minus high-voltage when the plus high-voltage output unit outputs the plus high-voltage.

7. The high-voltage power supply of claim 1, wherein the minus high-voltage output unit operates by using a ringing choke converter (RCC).

8. The high-voltage power supply of claim 1, wherein the minus high-voltage blocking unit blocks the outputting of the minus high-voltage by turning off a transistor to drive the minus high-voltage output unit by using a ground voltage output by the voltage generated in the plus high-voltage output unit by using the PWM signal.

9. The high-voltage power supply of claim 1, wherein the plus high-voltage output unit and the minus high-voltage output unit output the plus high-voltage and the minus high-voltage via the same output terminal.

10. A method of outputting a plus/minus high-voltage, the method comprising:

outputting the plus high-voltage by using a PWM signal;

charging a certain voltage, wherein the certain voltage is the minus high voltage for a minus high voltage source, while the plus high-voltage is being output;

outputting the minus high-voltage within a period of time from when outputting the plus high-voltage is stopped to when all of the accumulated voltage is discharged; and blocking the outputting of the minus high-voltage with a generated voltage while the plus high-voltage is output, wherein the minus high-voltage and the plus high-voltage are not output simultaneously.

11. The method of claim 10, wherein, in the charging of the certain voltage, a voltage supplied according to the PWM signal is charged while the plus high-voltage is output.

12. The method of claim 10, wherein, in the outputting of the minus high-voltage, when the plus high voltage is output again before all of the accumulated voltage is discharged, the minus high-voltage is output until when the plus high-voltage is output again.

13. The method of claim 10, wherein the plus high-voltage and the minus high-voltage are output via the same output terminal.

14. A computer-readable recording medium having recorded thereon a program to cause an image-forming apparatus to execute a method, the method comprising:

outputting a plus high-voltage by using a PWM signal;

charging a certain voltage, wherein the certain voltage is a minus high voltage for a minus high voltage source while the plus high-voltage is being output; and outputting the minus high-voltage within a period of time from when outputting the plus high-voltage is stopped to when the accumulated certain voltage is discharged; and blocking the outputting of the minus high-voltage with a generated voltage while the plus high-voltage is output, wherein the minus high-voltage and the plus high-voltage are not output simultaneously.

15. A high-voltage power supply, comprising:

a positive high-voltage output unit to receive a first input signal and to output a positive high-voltage corresponding to the first input signal;

a negative high-voltage output unit to receive a second input signal and to output a negative high-voltage corresponding to the second input signal;

a negative high-voltage operation control unit to charge a certain voltage, wherein the certain voltage is the negative high voltage for a negative high voltage source in the negative high-voltage operation control unit; and a negative high-voltage blocking unit to prevent the negative high-voltage output unit from outputting the negative high-voltage with a voltage generated in the positive high-voltage output unit when the positive high-voltage output unit outputs the positive high-voltage.

16. The high-voltage power supply according to claim 15, wherein the negative high-voltage blocking unit comprises:

an RC filter to receive an input from the positive high-voltage output unit; and a transistor having a gate connected to the input from the positive high-voltage output unit, the transistor configured to output a ground signal to the negative high-voltage output unit when the gate is on.

17. The high-voltage power supply according to claim 15, wherein the positive high-voltage output unit and the negative high-voltage output unit are connected to a same output terminal.

18. The high-voltage power supply according to claim 15, wherein the negative high-voltage operation control unit supplies an input voltage to the negative high-voltage output unit.

19. The high-voltage power supply according to claim 18, wherein the negative high-voltage operation control unit includes a capacitor to charge when the positive high-voltage output unit outputs the positive, high voltage and to discharge when the positive high-voltage output unit does not output the positive, high voltage.

20. The high-voltage power supply according to claim 19, wherein the capacitor is an electrolytic capacitor.

21. The high-voltage power supply according to claim 19, wherein the negative high-voltage operation control unit comprises:

a transistor having a gate connected to the first input and a source connected to a power supply, to output a predetermined voltage from the power supply to the capacitor to charge the capacitor when the gate is on.

22. The high-voltage power supply according to claim 19, wherein the capacitor of the negative high-voltage operation control unit is connected to an input from the positive high-voltage output unit, a voltage level of the input corresponding to a voltage level output from the positive high-voltage output unit.

23. A method of outputting a positive high-voltage and a negative high-voltage, the method comprising:

converting a first input signal into a positive high-voltage output signal;

converting a second input signal into a negative high-voltage output signal;

charging a certain voltage, wherein the certain voltage is the negative high voltage for a negative high voltage source in a negative high-voltage operation control unit while the positive high-voltage signal is being output; and blocking the output of the negative high-voltage signal with a voltage output by a positive high-voltage output unit when the positive high-voltage signal is output.

24. The method according to claim 23, wherein blocking the output of the negative high-voltage signal includes:

outputting a ground signal to a negative high-voltage output unit when the positive high-voltage signal is output.

25. The method according to claim 23, further comprising:

outputting the second input signal to a negative high-voltage output unit only when the positive high-voltage signal is not output.

26. The method according to claim 25, wherein outputting the second input signal comprises:

charging a capacitor when the positive high-voltage signal is output; and discharging the capacitor as the second input signal when the positive high-voltage signal is not output.

27. An image-forming apparatus, comprising:

an image-development unit to receive data and to form an image on a recording medium, the image-development unit including:

a photoconductor to form an electrostatic latent image; and a high-power voltage supply having an output node connected to the photoconductor to control a charge of the photoconductor, wherein, the high-power voltage supply comprises:

a positive high-voltage output unit to receive a first input signal and to output to the output node a positive high-voltage corresponding to the first input signal;

a negative high-voltage output unit to receive a second input signal and to output to the output node a negative high-voltage corresponding to the second input signal;

a negative high-voltage operation control unit to charge a certain voltage, wherein the certain voltage is the negative high voltage for a negative high voltage source in the negative high-voltage operation control unit; and a negative high-voltage blocking unit to prevent the negative high-voltage output unit from outputting the negative high-voltage with a voltage output by the positive high-voltage output unit when the positive high-voltage output unit outputs the positive high-voltage.

* * * * *